US006341733B1

(12) United States Patent
Sweet

(10) Patent No.: US 6,341,733 B1
(45) **Date of Patent: *Jan. 29, 2002**

(54) NUTATING SPRINKLER

(75) Inventor: Fred J. Sweet, College Place, WA (US)

(73) Assignee: Nelson Irrigation Corporation, Walla Walla, WA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/497,551

(22) Filed: Feb. 3, 2000

(51) Int. Cl.[7] ..... B05B 3/04

(52) U.S. Cl. ..... 239/222.17; 239/381; 239/498; 239/505

(58) Field of Search ..... 239/214, 222.11, 239/222.17, 222.19, 225.1, 231, 380, 381, 382, 461, 524; 229/498, 505, 518, 227, 232

(56) References Cited

U.S. PATENT DOCUMENTS

| | | | | |
|---|---|---|---|---|
| 2,639,191 | A | | 5/1953 | Hruby, Jr. |
| 2,848,276 | A | | 8/1958 | Clearman |
| 2,963,228 | A | | 12/1960 | Hait |
| 3,009,647 | A | | 11/1961 | Hait |
| 3,009,648 | A | | 11/1961 | Hait |
| 3,034,728 | A | | 5/1962 | Hruby, Jr. |
| 3,091,400 | A | | 5/1963 | Aubert |
| 3,312,400 | A | | 4/1967 | Clearman |
| 3,532,273 | A | | 10/1970 | Siddall et al. |
| 3,664,585 | A | | 5/1972 | Curtis |
| 3,759,445 | A | | 9/1973 | King |
| 4,011,917 | A | | 3/1977 | Tiraspolsky et al. |
| 4,073,438 | A | | 2/1978 | Meyer |
| 4,134,169 | A | | 1/1979 | Sinclair |
| 4,290,557 | A | | 9/1981 | Rosenberg |
| 4,356,972 | A | | 11/1982 | Vikre |
| 4,487,368 | A | | 12/1984 | Clearman |
| 4,883,228 | A | | 11/1989 | Vydrzal et al. |
| 5,007,586 | A | | 4/1991 | Cohen |
| 5,086,842 | A | | 2/1992 | Cholet |
| 5,381,960 | A | | 1/1995 | Sullivan et al. |
| 5,439,174 | A | | 8/1995 | Sweet |
| 5,588,595 | A | | 12/1996 | Sweet et al. |
| 5,671,885 | A | | 9/1997 | Davisson |
| 5,681,109 | A | | 10/1997 | Palmer |
| 5,765,945 | A | | 6/1998 | Palmer |
| 5,950,927 | A | | 9/1999 | Elliott et al. |
| 6,092,739 | A | * | 7/2000 | Clearman et al. ..... 239/381 |
| 6,129,293 | A | * | 10/2000 | Jager ..... 239/381 |

* cited by examiner

*Primary Examiner*—David A. Scherbel
*Assistant Examiner*—Christopher S. Kim
(74) *Attorney, Agent, or Firm*—Nixon & Vanderhye P.C.

(57) ABSTRACT

A nutating sprinkler assembly includes a sprinkler body having one end connected to an adapter; a nozzle mounted in the sprinkler body captured between the adapter and the sprinkler body; at least one arm extending from the sprinkler body for supporting a removable cap assembly downstream of the nozzle, the cap assembly having a center body supporting a rotor plate having off-center grooves for distributing a stream exiting the nozzle and impinging upon the grooves; a hub having one end secured in the rotor plate and an opposite end supporting a load disc, the load disc loosely captured between opposed rings provided in the center body; the center body having an end wall formed with a tilter button extending toward and engaging a center portion on an underside of the load disc when the rotor plate is in an at rest position, thereby creating an unstable arrangement causing the rotor plate to tilt to an off-center position.

10 Claims, 6 Drawing Sheets

NUTATING SPRINKLER

TECHNICAL FIELD

This invention relates to sprinkler devices and more specifically, to an improved sprinkler which incorporates a spray plate (or rotor plate) mounted for wobbling/rotating motion referred to herein as "nutation."

BACKGROUND

Moving irrigation systems such as conventional pivot or linear systems are known to incorporate conduit truss span assemblies which mount sprinkler heads, spaced along the truss assemblies for sprinkling or irrigating relatively large areas of land. The sprinkling heads may be mounted on top of the truss assemblies in a normal upright position, or they may be inverted and suspended from the span assemblies by means of drop tubes. Sprinkler heads are typically of the spinner type, which incorporate rotatable stream distributors (also referred to as rotor plates or spray plates, fixed spray plates or bubbler devices).

When irrigating large areas of land with pivot or linear sprinklers, the sprinklers need to be spaced apart as far as possible to minimize system hardware costs. To obtain an even distribution of the water at wide spacings requires sprinklers that simultaneously throw the water long distances and produce sprinkling patterns that are very even when overlapped with adjacent sprinklers. These two requirements are somewhat exclusive in that maximum radius of throw is achieved with concentrated streams of water shooting at relatively high trajectory angles. These streams, however, tend to produce a donut shaped sprinkling pattern at low pressure that does not overlap evenly. The use of nutating or wobbling sprinklers to enhance distribution uniformity particularly at low pressure is known in the art, as evidenced, for example, by U.S. Pat. Nos. 5,439,174; 5,671,885; and 5,588,595. Wobbling type sprinklers can be problematic in the sense that in some circumstances, the sprinkler simply rotates on its center axis without wobbling. This is particularly true if the sprinkler rotor plate is allowed to assume an on-center orientation when at rest.

A recently issued patent, No. 5,950,927, addresses this problem by mechanically constraining the rotor plate to always assume an off-center position.

SUMMARY OF THE INVENTION

This invention provides an improved rotor plate mounting arrangement which insures that the rotor plate will be tilted to an off-center position on start-up, thereby also insuring that the rotor plate will exhibit the desired nutating motion.

In a first exemplary embodiment, the rotor plate is supported in a center body of a removable cap assembly secured to a sprinkler body, with the rotor plate downstream of a fixed nozzle. The rotor plate is fixed to a hub protruding from the center of one side of a load disc captured loosely between a pair of annular rings located within the centerbody. In this embodiment, the hub includes a shaft extending into the rotor plate. At the same time, a tilter button or post projects upwardly toward the opposite side of the load disc and engages a center portion of the disc when the sprinkler is at an at rest position. Because of the inherently unstable nature of the engagement, i.e., where a top heavy rotor plate is supported essentially on a point contact, the rotor plate will tilt to one side. When water is supplied to the sprinkler, the rotor plate will rotate and wobble, i.e., nutate, in the desired manner, and the rotor plate will also separate slightly from the tilter button or post, thus reducing the potential for wear on the post. In this first embodiment, the tilter button or post is incorporated in a plug which is threaded into a cap center body which supports the rotor plate. In another variation of this embodiment, the tilter button or post is incorporated in a cover or plate secured to the center body by one or more fasteners.

In a second exemplary embodiment of the invention, the hub includes a spool and a shaft projecting from one side of the spool, with the other end of the shaft fixed in the rotor plate. The spool has upper and lower flanges, and an internal annular ring in the cap centerbody loosely supports the spool in an area between the upper and lower flanges. A tilter button or post extends vertically into a center recess in the other side of the spool, creating an unstable mounting arrangement as described hereinabove. Here again, the rotor plate assumes a tilted or off-center position when at rest, insuring that the desired nutating motion will occur on start-up.

In a third embodiment of the invention, the rotor plate is formed with an open-ended cylindrical stem which receives a relatively large diameter hub projecting from the center of one side of a load disc. In this embodiment, the load disc is captured between a pair of discrete, annular rings sandwiched between an interior shoulder in the cap center body and the cap cover or plug. As in the earlier described embodiments, a tilter button or post is formed integrally with the cover or plug and engages a center recess in the other side of the load disc.

In a fourth embodiment of the invention, an open cylindrical stem of the rotor plate receives a hub projecting from one side of a spool loosely captured within the cap center body by an internal ring or flange. The upper and lower spool flanges may be snap-fitted together, sandwiching a wear resistant spool bushing therebetween. The internal ring is held in place in the center body by the cover or plug which includes an integral post or tilter button projecting into a center recess in the other side of the spool.

Accordingly, in its broader aspects, the present invention relates to a nutating sprinkler assembly comprising a sprinkler body having one end connected to an adapter; a nozzle mounted in the sprinkler body captured between the adapter and the sprinkler body; at least one arm extending from the sprinkler body for supporting a removable cap assembly downstream of the nozzle, the cap assembly having a center body supporting a rotor plate having off-center grooves for distributing a stream exiting the nozzle and impinging upon the grooves; a hub having one end secured in the rotor plate and an opposite end supporting a load disc, the load disc loosely captured between opposed rings provided in the center body; the center body having an end wall formed with a tilter button extending toward and engaging a center portion on an underside of the load disc when the rotor plate is in an at rest position, thereby creating an unstable arrangement causing the rotor plate to tilt to an off-center position.

In another aspect, the present invention relates to a nutating sprinkler assembly comprising a sprinkler body supporting a nozzle and a rotor plate supported downstream of the sprinkler body; the rotor plate having a center axis defined by a hub extending between the rotor plate and a load disc confined within a rotor plate support such that the rotor plate is rotatable relative to the support; and wherein, at rest, the rotor plate and the load disc are supported on a tip of a post; creating an unstable arrangement causing the rotor plate and the hub to tilt relative to the center axis.

In still another aspect, the invention relates to a nutating sprinkler assembly comprising a sprinkler body having one end adapted to be coupled to a water supply conduit and an opposite end supporting a nozzle; at least one arm extending from the sprinkler body for supporting a removable cap assembly downstream of the nozzle, the cap assembly having a center body supporting a rotor plate having off-center grooves for distributing a stream exiting the nozzle and impinging upon the grooves; a hub secured to the rotor body and having an opposite end supporting a spool bearing having upper and lower spool flanges; the center body mounting an interior ring loosely supporting the spool bearing between the upper and lower spool flanges; the center body having an end wall formed with a tilter button extending toward and engaging a center portion of an underside of the spool bearing when the rotor plate is in an at-rest position, thereby creating an unstable arrangement causing the rotor plate to tilt to an off-center position.

DETAILED DESCRIPTION OF THE DRAWINGS

Figure 1:
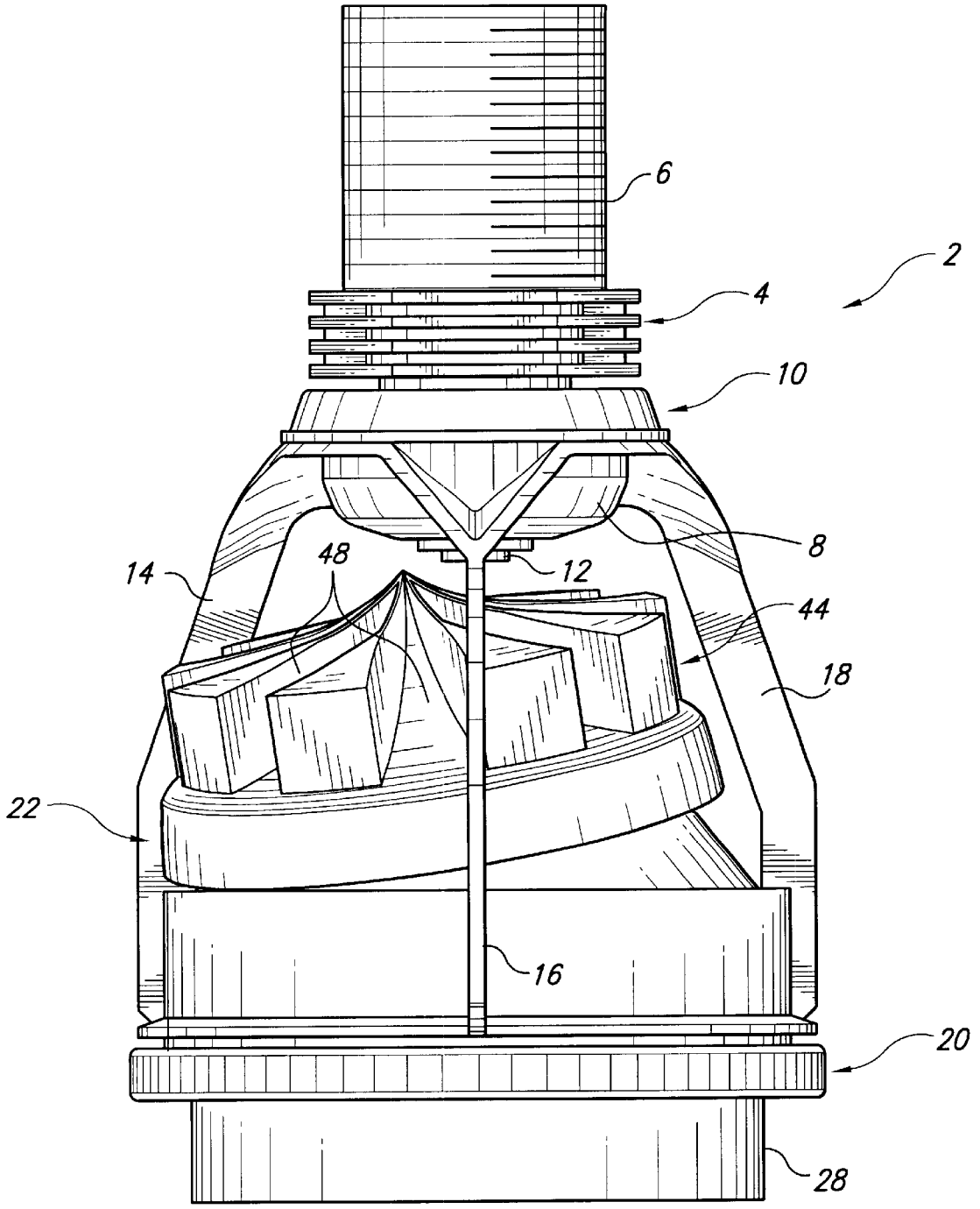
FIG. 1 is a side section of a rotatable sprinkler incorporating a nutating rotor plate in accordance with the first exemplary embodiment of the invention.

Referring to FIG. 1, the sprinkler 2 includes an adapter 4 having a threaded inlet 6 to be secured to a coupling or conduit (not shown). The outlet end of adapter 4 has a unique external thread that engages sprinkler body 8. A fixed nozzle 10 is captured between the outlet end of adapter 4 and the sprinkler body 8, the nozzle having a discharge orifice 12. Arms 14, 16 and 18 extend from the sprinkler body and support a removable cap assembly 20 which, in turn, supports a nutator assembly 22 within a central opening in the cap assembly. The cap assembly may be press-fit in the opening and held in place by an annular rib adapted to seat within a complementary groove defined by shoulder 24 and rib 26 formed on the nutating assembly centerbody 28. It will be appreciated, however, that the nutator assembly can be secured relative to the nozzle by any suitable means.

Figure 2:
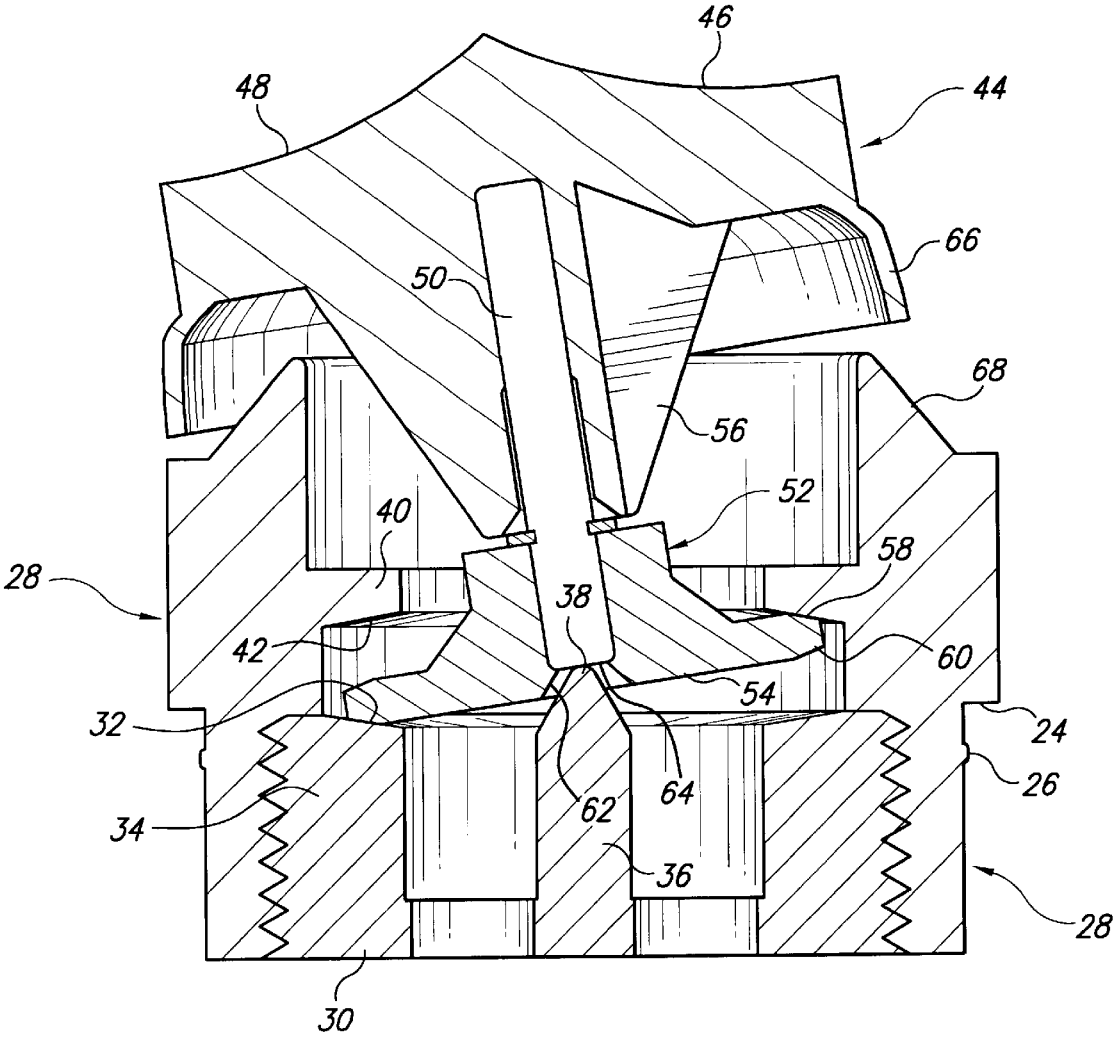
FIG. 2 is an enlarged detail taken from FIG. 1.

With reference also to FIG. 2, the centerbody 28 includes a plug 30 threaded into one end of the centerbody, the plug having an internal peripheral inclined surface 32 about its inner end 34. The plug is also formed with a tilter button or post 36 having rounded point or tip 38 at its free end. The cap centerbody 28 also includes an interior annular flange 40, one surface 42 of which is also slightly inclined in the radial direction.

A rotor plate 44 includes a rotor body 46 having a series of water deflecting grooves 48 therein which are circumferentially offset to cause the rotor plate to rotate when a stream from the nozzle 16 impinges on the grooves 48. A shaft 50 extends from a hub 52 projecting from the center of a one side of load disc 54. The other end of the shaft is received in a stem 56 of the rotor body 46. The load disc 54 has opposed inner and outer peripheral surfaces 58, 60 adapted to cooperate with surfaces 42, 32, respectively. A center recess 62 on the other side of the load disc 54 exposes the shaft bottom 64. The load disc 54 is loosely captured between the surface 42 of flange 40 and the inner surface 32 of the plug 30.

When at rest, the shaft bottom 64 rests on the point or tip 38 of the tilter button 36, creating an inherently top-heavy, unstable arrangement, that causes the rotor plate 44, shaft 50 and load disc 54 to tilt to one side, as best seen in FIG. 2. Notice that surface 58 of disc 54 is not engaged with surface 42 of ring 40.

When water is supplied to the sprinkler 2, the instability of the rotor plate vis-a-vis the tilter button 36 insures that rotor plate 44 will begin nutating (or wobbling) as it rotates, and not merely assume a stable, on-center position. As the rotor plate 44 begins to rotate, the tilting action will increase to the extent that both of the opposed surfaces 58, 60 on the load disc 54 will engage respective surfaces 42 of flange 40 and 32 of the plug 30. With this additional degree of tilt, illustrated in FIG. 3, the shaft bottom 64 will separate slightly from the tilter button 36, minimizing wear on the tilter button. The degree of tilt when the rotor plate is rotating may be about 10° to 12°.

It will also be appreciated that annular skirt 66 extending from the rotor plate 44, and annular surface 68 at the inner end of the cap centerbody 24 cooperate to minimize intrusion of any debris into the area of the hub 52 and load disc 54.

While the assembly is shown in FIG. 1 and FIG. 2 oriented so as to receive a stream from above the rotor plate 44, it will be appreciated that the assembly may be inverted so that the stream rotor plate "hangs" by means of load disc 54. The sprinkler nevertheless operates in substantially the same manner as described above, except that on start-up, the stream will push the rotor body 46 upwardly, causing the shaft bottom 64 to engage the tilter button 36. Again, the instability of the arrangement will cause the rotor plate 44 to tilt, insuring the desired nutating motion will commence when the stream impinges on the grooves 48 of the rotor plate.

Wear resistant coatings or materials may be used as desired to reduce wear at the points of engagement of the load disc 54 with the surface 42 of the flange 40 and surface 32 of plug 30.

Figure 3:
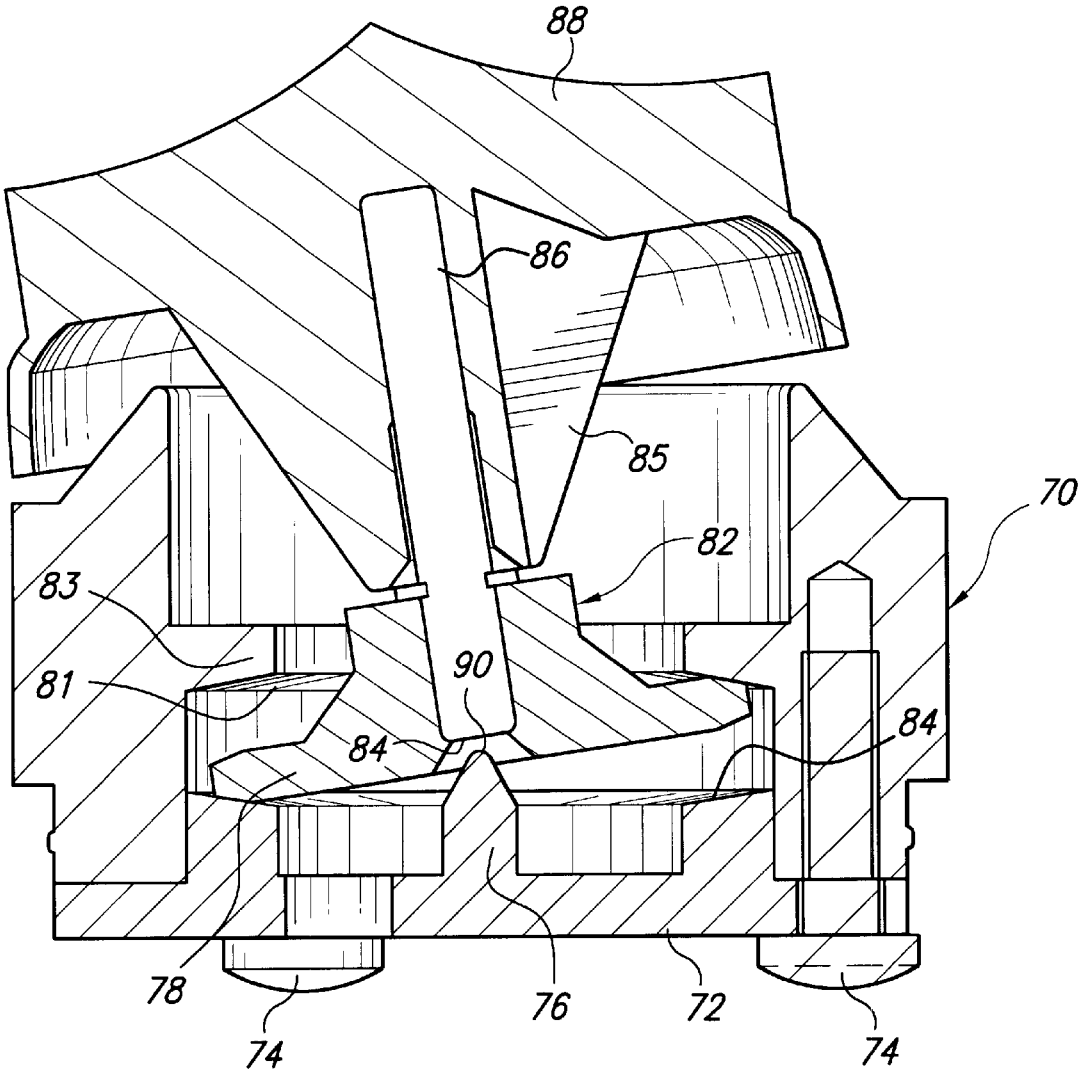
FIG. 3 is an enlarged detail of a variation of the rotor plate assembly shown in FIGS. 1 and 2.

In an alternative arrangement illustrated in FIG. 3, a cap centerbody 70 is axially shortened and the plug 30 is replaced by a cap cover or plate 72 fastened to the cap centerbody 70 via circumferentially spaced screws 74. A tilter button 76 extends inwardly from the cap cover 72, extending toward one side of a load disc 78. The load disc 78 is formed integrally with the hub 82 and is loosely captured between the lower surface 81 of the interior annular flange 83 and an interior peripheral surface 84 on the cap cover 72. The device is otherwise similar in construction and operation to the first exemplary embodiment shown in FIGS. 1 and 2, noting that hub 82 includes a shaft 86 that extends into the stem 85 of the rotor body 88. As already noted, FIG. 3 illustrates the position of load disc 78 during rotation, when it (and the bottom 84 of shaft 86) separate slightly from the tip 90 of tilter button 76.

Figure 4:
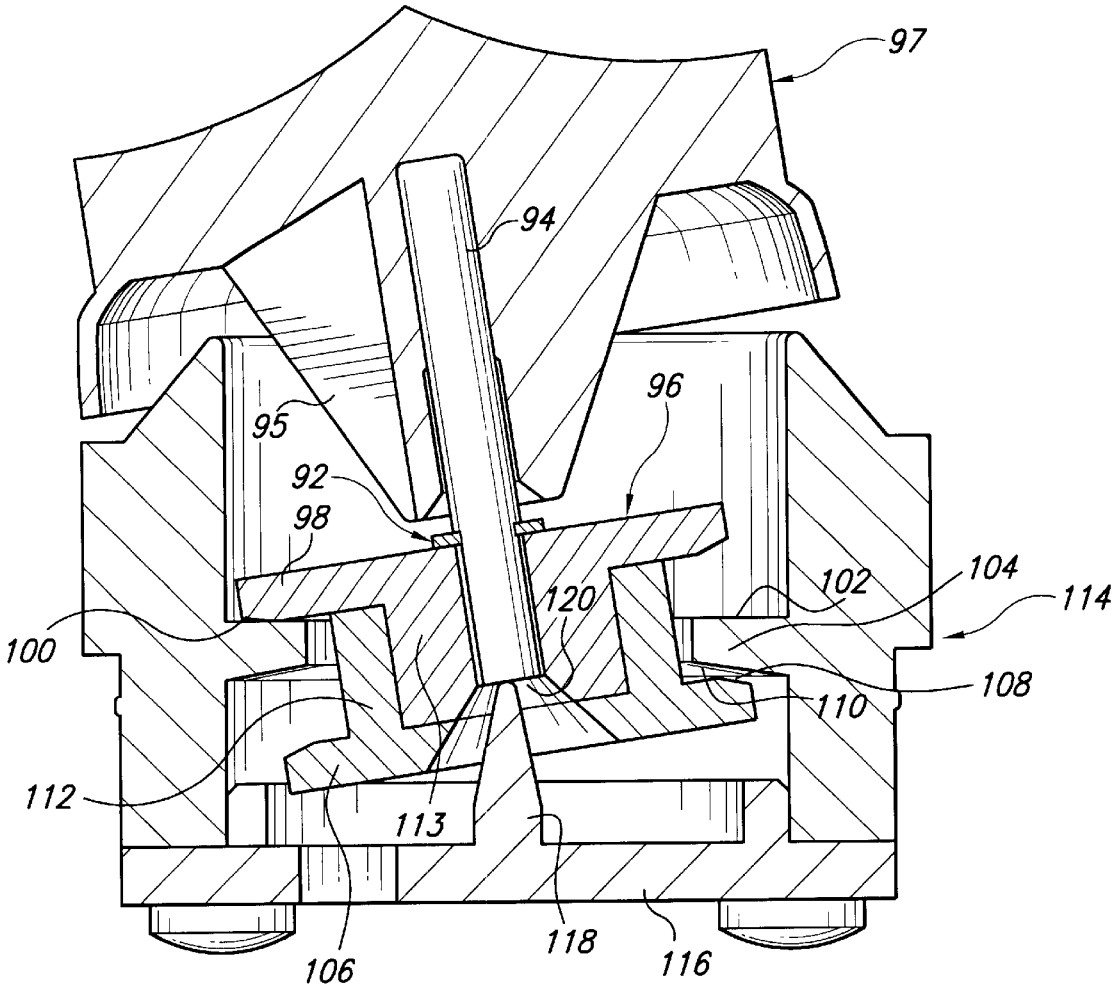
FIG. 4 is a cross section of a rotor plate assembly in accordance with a second exemplary embodiment of the invention.

In a second embodiment of the invention illustrated in FIG. 4, the hub 92 includes a shaft 94 extending from a two-piece spool 96 and received in a stem 95 of the rotor body 97. The spool 96 includes a first or upper flange 98 providing a first peripheral surface 100 adapted to engage a first facing surface 102 of the inner flange ring 104. The spool also includes a second or lower flange 106 providing a second peripheral surface 108 adapted to engage the undersurface 110 of the inner flange ring 104. The cylindrical portion 112 projecting from lower flange 106 telescopes over the solid center portion 113 projecting from the upper flange 98.

The cap center body 114 is closed by a cap cover or plate 116 and includes an integral tilter button 118 adapted to engage the shaft bottom 120 when the sprinkler is at rest. Note that the spool 96 does not engage any interior surface of cover 116 other than the tilter button 118. The structure shown in FIG. 4 is otherwise similar in construction and operation to the above described alternative embodiments.

Figure 5:
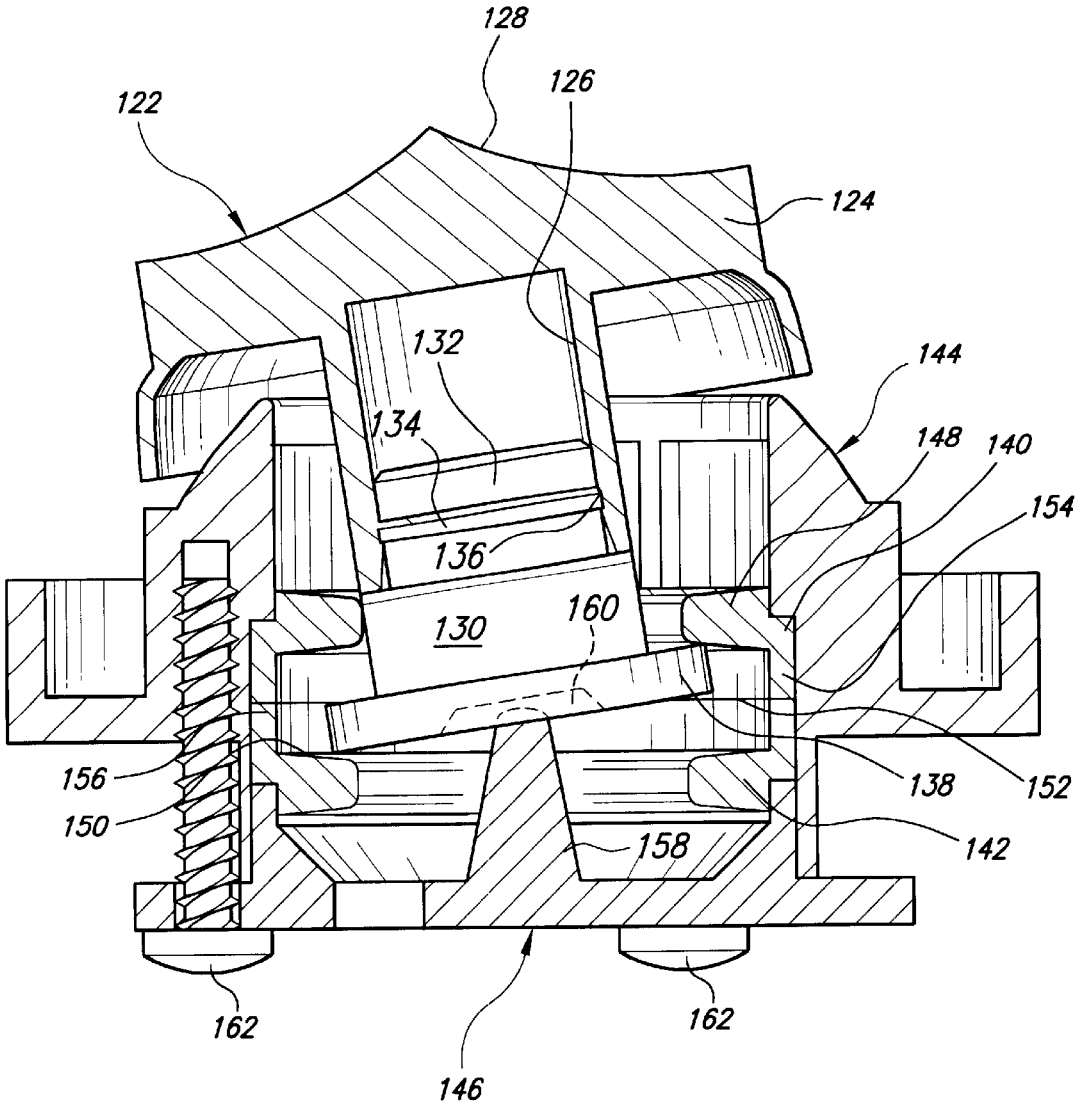
FIG. 5 is a cross section of a rotor plate assembly in accordance with a third exemplary embodiment of the invention.

Turning now to FIG. 5, a third exemplary embodiment of the invention is disclosed in which modifications are made with respect to the manner in which the rotor plate is connected to the load disc. Specifically, the rotor plate 122 incorporates a rotor body 124 having an open-ended cylindrical stem 126 extending away from the grooves 128 in the external surface of the rotor plate. The stem is adapted to receive in snap-fit relationship a hub 130 which includes a reduced diameter projection 132 having an annular rib 134 adapted to cooperate with a groove 136 in the stem 126, facilitating the snap-fit relationship within the stem. The load disc 138 is formed integrally with the hub and is loosely confined between a pair of discrete annular rings 140 and 142 sandwiched between the cap centerbody 144 and the cap end cover or plug 146. These annular rings are preferably formed of a wear resistant plastic material with a radial surface 148 of the upper ring cooperating with a radial surface 150 of the lower ring to confine the load disc 138 therebetween. The two annular rings 140, 142 join at an interface 152 defined by the edges of axial portions 154, 156, respectively, of the rings, and it will be appreciated that the rings must be separable in order to permit the assembly of the hub 130 within the cap centerbody 144. The end cover or plug 146 incorporates an integral tilter button or post 158, the free end of which engages within a center recess 160 formed in the lower side of the load disc 138. The cap end cover or plug 146 may be secured to the cap centerbody by a plurality of screws 162. The manner of operation of the rotor plate and the load disc vis-a-vis the tilter button is otherwise similar to the previously described embodiments.

Figure 6:
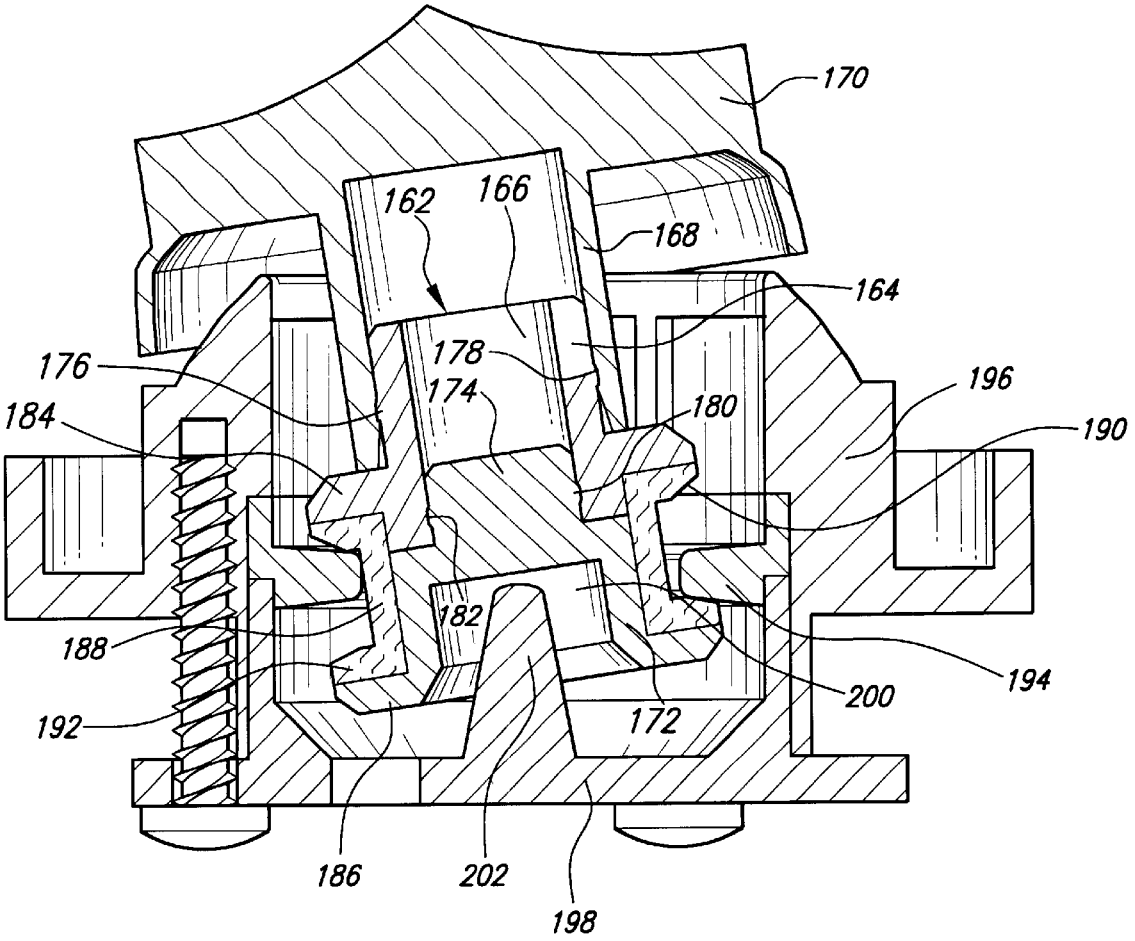
FIG. 6 is a cross section of a rotor plate assembly in accordance with a fourth embodiment of the invention.

FIG. 6 illustrates yet another embodiment of the subject invention, generally combining the features disclosed with respect to the embodiment illustrated in FIG. 4 and the features illustrated in FIG. 5. Thus, the hub 162 is formed as a two-piece spool, with an upper part 164 of the spool including a hollow cylindrical projection 166 adapted to be snap-fit within the open-ended cylindrical stem 168 projecting away from the rotor body 170. A lower spool element 172 is snap-fit within the upper spool element, with a solid projection 174 extending into the center opening of the spool upper part 164. An annular rib 176 on the projection 166 adapted to seal in a complimentary groove 178 in the stem 168 facilitates attachment of the upper spool element to the stem, while an annular rib 180 formed on the solid projection 174 of the lower spool element cooperates with a complimentary groove 182 in the upper spool part 164 facilitates connection of the lower spool element 172 to the upper spool element.

Between the opposing flanges 184 and 186 of the upper and lower spool elements, respectively, there is a conforming wear element or bushing 188 (made of any suitable wear resistant material) which also includes upper and lower wear surfaces 190 and 192, respectively. These upper and lower surfaces of the wear element are loosely confined by an internal annular ring 194 seated within the cap centerbody 196 and held in place by the end cover or cap 198. The annular ring 194 may also be made of a wear resistant plastic.

The lower spool element 172 is formed with a center recess 200 adapted to receive a tilter button or post 202 extending upwardly from the end cover or plug 198. This device operates in a manner similar to the embodiment illustrated in FIG. 4 as explained hereinabove.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A nutating sprinkler assembly comprising:

a sprinkler body having one end adapted to be coupled to a water supply conduit and an opposite end supporting a nozzle;

at least one arm extending from said sprinkler body supporting a center body and a rotatable rotor plate downstream of said nozzle, said rotor plate having off-center grooves for distributing a stream exiting said nozzle and impinging upon said grooves;

a hub having one end secured to said rotor plate and an opposite end, a spool bearing, the spool bearing having upper and lower spool flanges; said center body mounting an interior ring loosely supporting said spool bearing between said upper and lower spool flanges; said center body having an end wall formed with a tilter button extending into a recessed center portion of an underside of said spool bearing when said rotor plate is in an at-rest position, thereby creating an unstable arrangement causing said rotor plate to tilt to an off-center position.

2. The nutating sprinkler assembly of claim 1 wherein, during nutating motion of said rotor plate, surfaces of said upper and lower spool flanges are engaged, respectively, with upper and lower surfaces of said interior ring.

3. The nutating sprinkler assembly of claim 2 wherein, during nutating movement of said rotor plate, said tilter button is disengaged from said center portion.

4. The nutating sprinkler assembly of claim 1 wherein said tilter button comprises a post having a rounded point.

5. The nutating sprinkler assembly of claim 1 wherein said end wall comprises a removable cover.

6. The nutating sprinkler assembly of claim 5 wherein said cover is secured to said center body by one or more screws.

7. The nutating sprinkler assembly of claim 1 wherein said upper and lower spool flanges are separable.

8. The nutating sprinkler assembly of claim 7 including a wear resistant insert located between said upper and lower spool flanges.

9. The nutating sprinkler assembly of claim 1 wherein said hub includes a projection and wherein said rotor body includes an open-ended cylindrical stem that receives said projection.

10. A nutating sprinkler assembly comprising:

a sprinkler body having one end adapted to be coupled to a water supply conduit and an opposite end supporting a nozzle;

at least one arm extending from said sprinkler body supporting a removable cap assembly downstream of said nozzle, said cap assembly having a center body supporting a rotor plate having off-center grooves for distributing a stream exiting said nozzle and impinging upon said grooves;

a hub secured at one end to said rotor plate and having an opposite end supporting a spool bearing, said spool bearing having upper and lower spool flanges; said center body mounting and interior ring loosely supporting said spool bearing between said upper and lower spool flanges; said center body having an end wall formed with a tilter button extending toward and engaging a center portion of an underside of said spool bearing when said rotor plate is in an at-rest position, thereby creating an unstable arrangement causing said rotor plate to tilt to an off-center position; and wherein said center portion is defined by a recess.

* * * * *